United States Patent [19]

Brave et al.

[11] 4,041,265

[45] Aug. 9, 1977

[54] ELECTRIC SWITCH

[76] Inventors: Ronald M. Brave, 3950 McDonogh Road, Randallstown, Md. 21133; Dennis G. Brave, Glencliffe Circle, Brooklandville, Md. 21022; Arnold S. Feldeman, 10 Melisa Court, Owings Mill, Md. 21208

[21] Appl. No.: 659,515

[22] Filed: Feb. 19, 1976

[51] Int. Cl.[2] ..... H01H 3/12; H01H 13/64

[52] U.S. Cl. ..... 200/159 R; 200/61.76; 200/153 K; 340/274 R

[58] Field of Search ..... 200/61.76, 61.79, 153 K, 200/159 R, 165; 340/274 R

[56] References Cited

U.S. PATENT DOCUMENTS

| | | | |
|---|---|---|---|
| 2,065,904 | 12/1936 | Meuer | 200/159 R |
| 2,155,765 | 4/1939 | Meuer | 200/61.76 |
| 2,727,964 | 12/1955 | Krenke | 200/153 K X |
| 3,797,006 | 3/1974 | Reininger | 340/274 |

*Primary Examiner*—Volodymyr Y. Mayewsky
*Attorney, Agent, or Firm*—Shoemaker and Mattare, Ltd.

[57] ABSTRACT

An improved electric switch of the type wherein a plunger mounted contactor contacts electric terminals to actuate or deactuate an electric circuit such as a security alarm circuit. The contactor fits into holes defined in the terminals, which are sized so that the contactor contacts the terminals when the plunger is pushed into the switch beyond a predetermined position, or the plunger is released by removing a protection plate, thereby actuating the electric circuit. One embodiment of the invention has a bullet-shaped plunger.

7 Claims, 10 Drawing Figures

FIG. 4A.
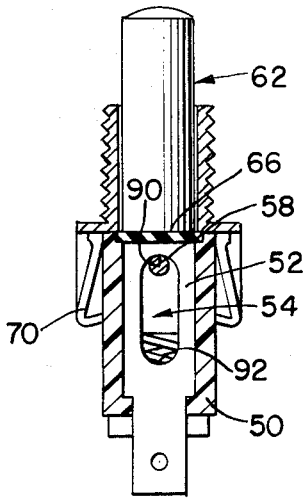
FIG. 4B.
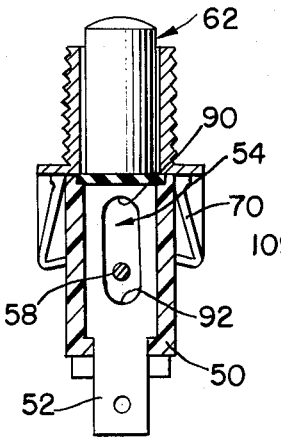
FIG. 5A.
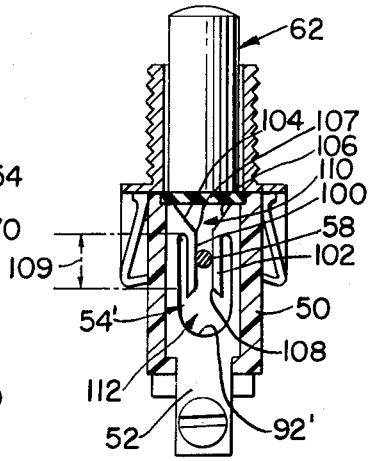
FIG. 5B.
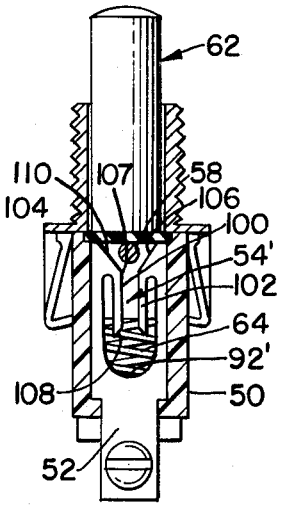
FIG. 4C.
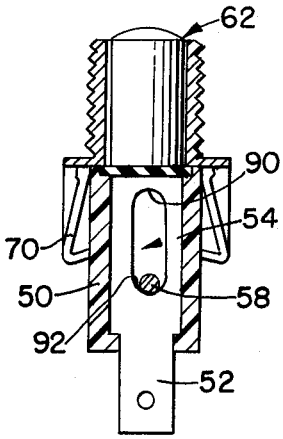
FIG. 5C.
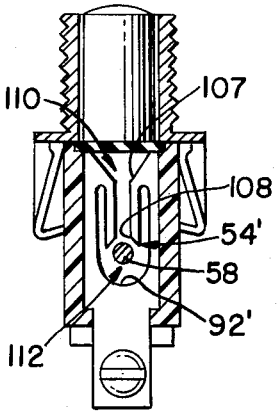
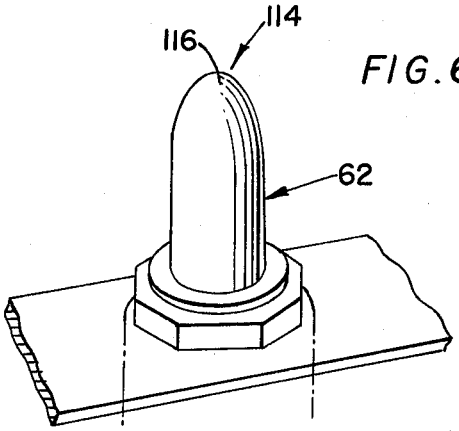
FIG. 6.

ELECTRIC SWITCH

BACKGROUND OF THE INVENTION

The present invention relates to electric switches and, more particularly, to an improved electric switch used in security alarm systems.

Almost all security alarm systems utilize a key operated control switch to permit an authorized person to enter a building, home, or the like without sounding the alarm. The control switch is turned ON to activate the system and OFF to deactivate the system. In security systems used to protect homes against entry by unauthorized persons, these control switches are often located adjacent frequently used entry and exit doors outside the home to encourage the homeowner to activate the system every time he leaves home. However, such externally located switches are susceptible to the tampering of a potential intruder. Thus, if a potential intruder wishes to deactivate the security system, he can do so by removing the control switch from its mounting and cutting, jumping or shorting out appropriate wires to disarm the system.

To prevent such tampering, most security alarm systems include a protective face plate covering the control switch to prevent unauthorized access thereto, and a hidden anti-tamper switch which activates the alarm system if the protective face plate is removed without first deactivating the system. The anti-tamper switch is generally of the normally closed or normally open type which is held in the open or closed position by the protective face plate, and which is biased to assume that position which activates the alarm when the face plate is removed. Thus, as above discussed, in order to tamper with the control switch, a potential intruder must first remove the protective face plate, however, removal of that face plate activates the system via the anti-tamper switch. A switch which can be adapted for use as an anti-tamper switch is shown in G. J. Meuer U.S. Pat. No. 2,065,904. As used herein, a "normally closed" switch is one which is closed when a face plate is on the unit. Likewise, a "normally open" switch is one which is open when a face plate is on the unit.

While effective, such a security system can still be circumvented if the anti-tamper switch is circumvented so that the face plate can be removed to provide access to the control switch for removal and deactivation thereof. Once the control switch is deactivated, the security alarm system is disarmed, and entrance can be easily effected by an intruder.

Heretofore, it has been assumed by security alarm system designers that switches such as the one described in the aforementioned Meuer patent are adequate protection against unauthorized removal of the protective face plate. Therefore, almost all known key-operated security alarm systems which are protected by a face plate, from the most inexpensive to the most complex, elaborate and expensive systems, use such anti-tamper switches. However, it is, in fact, an easy task to circumvent presently known anti-tamper switches. One simply ascertains what portion of the face plate is holding the switch in the depressed position, then drills a hole through the face plate at that ascertained position, and inserts a stiff rod, such as a coat-hanger, through the hole in the face plate to hold the anti-tamper switch in the depressed position. With the anti-tamper switch thus "artificially depressed", that is, depressed by the rod instead of the face plate, the protective face plate can be removed as the switch will not move into the circuit activating position upon removal of the face plate since the rod is held on the switch to keep it depressed. Once the face plate is removed, the control switch is exposed and can be moved into a position whereat the wires leading therefrom to the security alarm circuit are exposed, and the system can be deactivated by clipping, jumping, or shorting out those lead wires. Thus, even the most expensive and elaborate security alarm systems can be deactivated and thus defeated in a very short period of time by a semi-or unskilled intruder. Thus, no matter how elaborate and expensive, almost any known security alarm system employing a face plate is vulnerable to such easy circumvention by artificially maintaining the anti-tamper switch in the depressed position so that the switch does not sense the removal of the face plate which prevents access to the system control switch.

Even placing metal plates, or the like, in the protective face plate over the anti-tamper switch does not adequately prevent circumvention of that switch by the above-described method as high speed drills can be used to drill through even the hardest of plates.

It is noted that in order to circumvent the anti-tamper switch as above-described, the switch must be "artificially depressed", that is, held in the depressed position by means other than the protective face plate while that plate is being moved. The present invention provides an anti-tamper switch which is wired into the security alarm circuit to trigger the alarm immediately if an attempt is made to remove the face plate or artificially depress the anti-tamper switch while the security system is ON.

SUMMARY OF THE INVENTION

The present invention provides an anti-tamper switch for use with a security alarm system and which has an extremely high likelihood of activating the alarm circuit to which it is attached if it is "artificially depressed", that is, held in the depressed or normal position by any means other than those system elements designed and intended to perform this function when the system is ON. The anti-tamper switch of the present invention is primarily intended to be used in conjunction with a protective face plate which covers a main system control switch.

According to the teachings of the present invention, the electric switch described in Meuer U.S. Pat. No. 2,065,904 is modified to provide a three position switch. Accordingly, the disclosure of the just-mentioned patent is incorporated by reference in this patent disclosure.

The switch of the Meuer patent comprises a plunger which is received within a bore defined in a body. The plunger moves inwardly and outwardly of the body in accordance with the operating mode of the switch. In one configuration of the Meuer device shown in FIG. 1 of that patent, the contacts of the switch are described as having the upper portions thereof punched out to provide substantially elliptical openings through which opposite ends of a contactor rod are adapted to extend. The contactor rod is mounted on the plunger and a spring biases the plunger into a first position so that the contactor rod engages the terminals along one edge of each of the elliptical openings. The openings are sized to have a length which exceeds the distance of travel of the plunger mounted contactor rod. Thus, in a second position, which is the normal position of the switch in the circuit, the plunger is depressed and disposed inwardly of the bore and the contactor rod does not engage the terminals. Furthermore, the length of the openings is such that even though the plunger is fully depressed, the rod will not come into engagement with the terminals. The switch disclosed by Meuer is thus a two-position switch, that is, it is adapted to assume a first position wherein the plunger is not depressed, i.e. released, and a second position when the plunger is depressed, either slightly or completely.

According to the teachings of the present invention, the electric switch disclosed by Meuer is modified by reducing the length of the elliptical openings in the terminals so that the length thereof is less than the distance of travel of the plunger mounted contactor rod. Thus, when the plunger is not depressed at all (i.e., the first position) it is biased by the spring so that the contactor arm contacts the terminals along one edge of each of the openings to close the switch and complete the circuit in which it is incorporated. If the plunger is depressed slightly (i.e., the second position), the contactor rod moves out of engagement with those edges of the openings thus openings the circuit.

As thus described, the operation of the switch embodying the present invention is identical with the operation of the Meuer switch. However, the reduced length of the openings in the switch embodying the present invention produces a third position for the switch. Thus, if the plunger is depressed inwardly beyond a predetermined position, which is less than the full length of travel of the plunger, the reduced length of the terminal openings causes the contactor arm to come into engagement with the edges on the other end of the major dimension, i.e., the length, of the openings thereby closing the switch and completing the circuit. Thus, in a vertically oriented switch, the first-mentioned opening edges are the upper edges, and the last-mentioned edges are the lower edges; or forward and rear edges respectively for a horizontally oriented switch. Therefore, because of the reduction in length of the elliptical openings in the terminals, the Meuer switch is converted from a two position switch into a three position switch where the third position has the contractor arm engaged against the edges of the terminals on the other end of the terminal openings to complete the circuit.

Because the contactor arm will contact the terminals to complete the circuit if the plunger is depressed beyond a predetermined position, the switch can be used as an anti-tamper switch in a security alarm system incorporating a control switch protected from tampering by a protective face plate. If a potential intruder attempts to artificially depress the anti-tamper switch using a stiff rod inserted through a hole in the face plate, the chances are extremely good that the plunger of the anti-tamper switch designed in accordance with the present invention will be moved into the third position. In that third position, the circuit will be completed in the same manner as it is when the switch is in the first position. As above discussed, either the first or the third position will complete the circuit and activate the alarm system.

The distance between the second and third positions of the switch embodying the present invention can be adjusted by altering the lengthwise dimension of the terminal openings of the anti-tamper switch so that any degree of sensitivity can be obtained for the switch. An extremely sensitive switch can be triggered by any inward movement of the plunger from the second position. Thus, even the very slight depression of the plunger which results when a drill bit breaks through the face plate and contacts the plunger can be used to move the plunger into the third position thus triggering the alarm circuit. Also, other less sensitive distances can be used to prevent inadvertent triggering of the alarm through accidental contact with the face plate.

Another embodiment of the present invention includes a three position switch having the first and third positions thereof adapted to open the circuit. The terminals shown in FIGS. 4 and 5 of the Meuer patent are modified to add the third position for this embodiment.

A further embodiment of the present invention includes a plunger having an upper end which is bullet-shaped with the apex thereof forming the outermost tip of the plunger, i.e., that tip extending outwardly of the switch body. The bullet shape of the upper end prevents an extremely small surface area so that it is very difficult to support the tip of an instrument, such as a stiff rod, on that apex. Thus, it is difficult to depress the plunger using the tip of an instrument inserted through a hole in the face plate.

OBJECTS OF THE INVENTION

It is therefore a main object of the present invention to decrease the possibility of deactivating a security alarm system by a potential intruder.

It is another object of the present invention to prevent the circumvention of an anti-tamper switch used to prevent the deactivation of a security alarm system control switch by an unauthorized person.

These together with other objects and advantages which will become subsequently apparent reside in the details of construction and operation as more fully hereinafter described and claimed, reference being had to the accompanying drawings forming part hereof, wherein like numerals refer to like parts throughout.

BRIEF DESCRIPTION OF THE DRAWINGS

FIGS. 4A through 4C are vertical sections through the switch and the plunger elements of the switch embodying the teachings of the present invention;

FIGS. 5A through 5C are vertical sections through the switch and plunger elements of an alternative embodiment of the present invention; and FIG. 6 is a fragmentary perspective of a modification of the plunger end.

DETAILED DESCRIPTION OF THE PREFERRED EMBODIMENT

Figure 1:
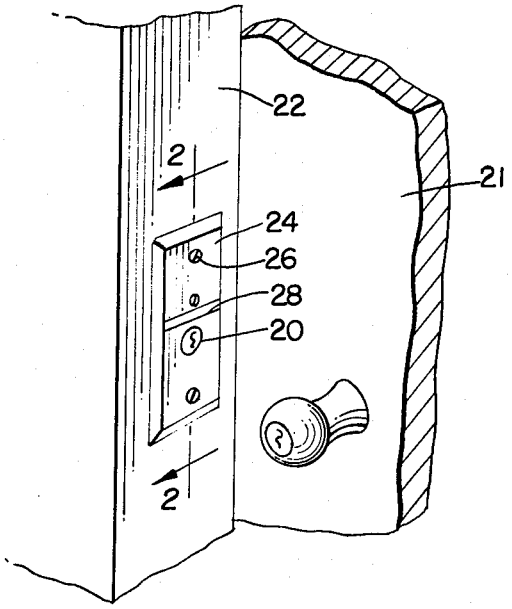
FIG. 1 is a detailed perspective view of an alarm system control unit utilizing an anti-tamper switch in accordance with the teachings of the present invention.

Shown in FIG. 1 is a key operated control switch 20 located adjacent a door 21 for activating and/or deactivating a security alarm system of the known type. The security alarm system can be either the known open circuit type or closed circuit type. The control switch 20 is mounted on a doorjamb 22, or other convenient location, and includes a protective face plate 24 mounted thereover, and secured to a mounting plate by fastening means, such as screws 26.

When the security alarm system is used to protect a home, the homeowner activates, or deactivates the system on his way out of, or into his home. As discussed above, the control switch 20 is generally located outside of the home, and as such, is subject to the tampering of a potential intruder. The face plate 24 includes a medial rib 28 which maintains an anti-tamper switch in a normal position, and which releases that switch if the face plate is removed. The anti-tamper switch will activate the alarm system if the face plate is removed when the system is ON.

Figure 2:
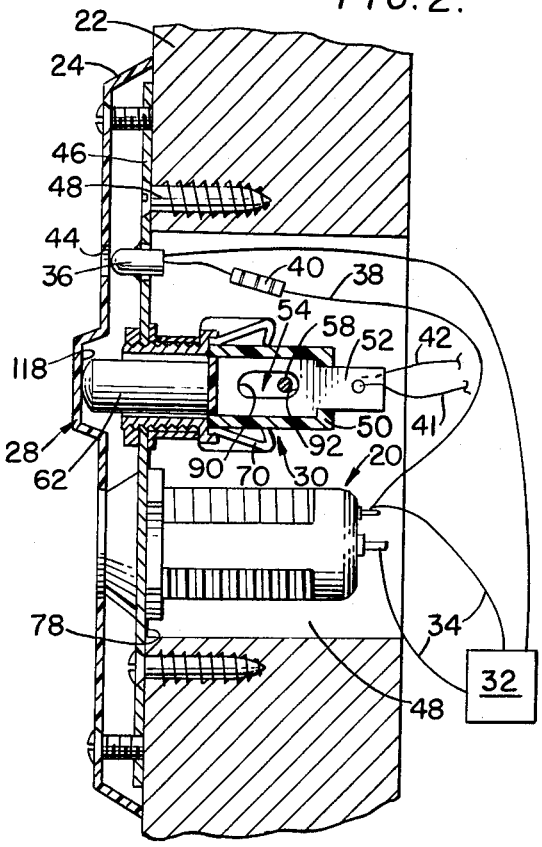
FIG. 2 is a vertical section along line 2—2 of FIG. 1.

As shown in FIG. 2, the key operated control switch 20 is located adjacent an anti-tamper switch 30 and is connected to an alarm circuit 32 of known construction by lead wires 34 and to light emitting diode 36 via wire 38 and resistor element 40. The switch 30 is suitably connected to the circuit 32 via leads 41 and 42 according to whether the anti-tamper switch 30 is a normally open, or a normally closed type switch. The leads 41 and 42 are shown to be independent of the rest of the circuit to illustrate that the connection depends upon the type of switch. The face plate 24 has an opening 44 through which the light emitting diode is visible to indicate when the system is ON. A mounting plate 46 secured to the mounting element 22 by wood screw 48 mounts the control switch 20 and anti-tamper switch 30 in a mounting well 48 in the mounting element 22.

Figure 3:
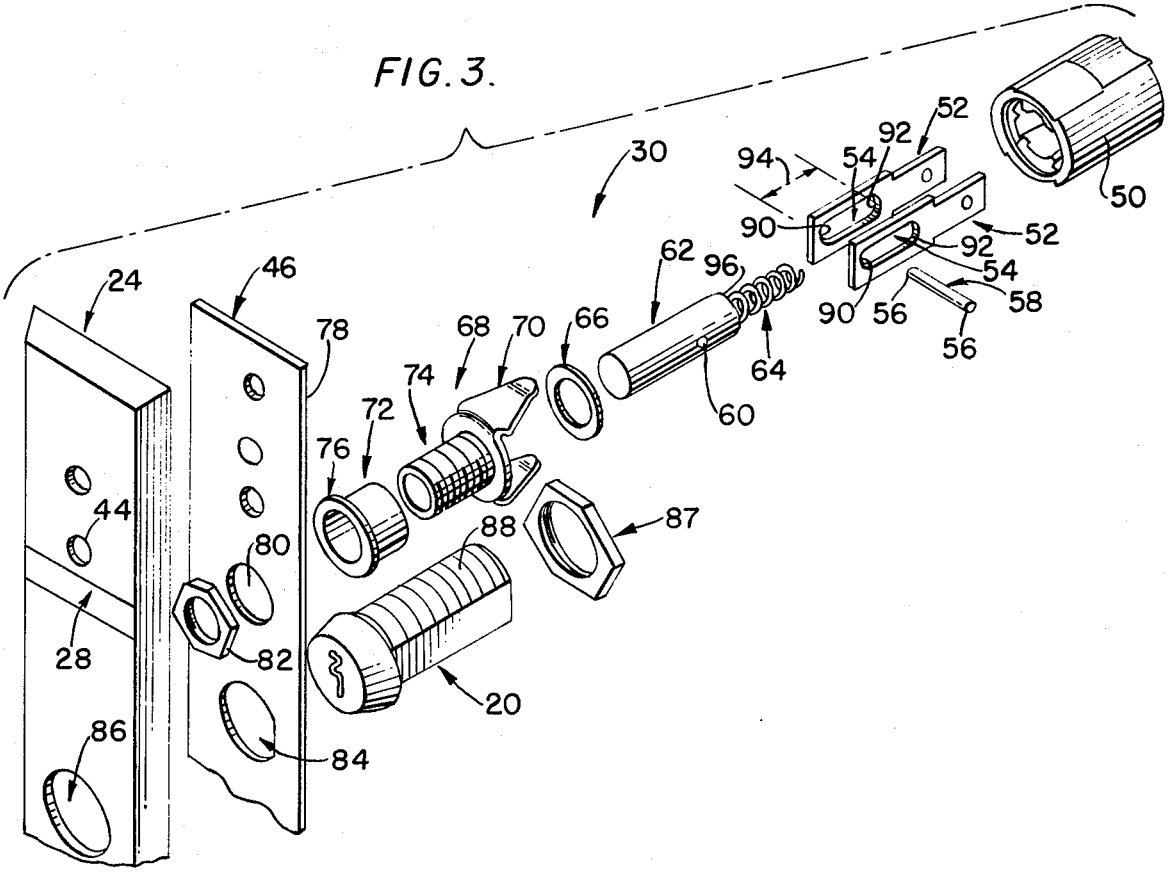
FIG. 3 is an exploded perspective view of the anti-tamper electric switch embodying the teachings of the present invention.

FIG. 3 shows the elements of switch 30 in a horizontal orientation. Switch 30 is fully described in detail in Meuer U.S. Pat. No. 2,065,904, and reference is made thereto for such detailed description. Briefly, switch 30 comprises a hollow base element 50 which receives therein terminals 52 to which are attached the circuit lead wires. The terminals 52 each has defined therein an elliptical opening 54 at the forward section thereof which receives the opposite ends 56 of contactor rod 58 which is mounted in diametrically oriented hole 60 through plunger 62. The contactor rod is therefore mounted on the plunger 62 and moves therewith. The plunger 62 is received within base element 50 between terminals 52 and moves inwardly and outwardly of the base element in accordance with the mode of operation of the switch. A spring 64 is seated at one end in base element 50 and at the other end in plunger 62 for biasing the plunger into an outwardly oriented position. An annular insulating ring 66 is seated around the upper marginal edge of the base element 50 and insulates the base element 50 from electrical contact with externally threaded coupling element 68 which is held on the base element 50 by wings 70. A sleeve 72 fits over the threaded section 74 of the coupling element 68 and has a mounting plate engaging flange 76 surrounding the upper portion thereof. The mounting plate engaging flange 76 engages the undersurface 78 of the mounting plate 46, and the upper portion of the threaded section 74 extends through cooperating hole 80 defined in mounting plate 46 for threadably engaging a complementary threaded nut 82 to hold the switch 30 on mounting plate 46 in the position shown in FIG. 2. The key operated control switch 20 fits into complementary holes 84 and 86 in mounting plate 46 and face plate 24 respectively, and is held therein by nut 87 threaded onto complemental screw threads 88 until the nut is seated against the mounting plate 46.

For the horizontal orientation shown in FIGS. 1 through 3, the elliptical openings 54 each have a forwardly positioned edge 90 and a rearwardly positioned edge 92 separated by a lengthwise dimension 94. As described in the Meuer patent, the contactor rod 58 moves lengthwise of the openings 54 and completes a circuit when that rod contacts forwardly positioned edges 90 of the openings 54. As disclosed in the Meuer patent, the lengthwise dimension 94 of the openings 54 exceeds the distance through which rod 58 travels from its forwardmost position engaging edges 90 of the openings 54 to the rearmost position of plunger 52 wherein the rearmost edge 96 of the plunger engages an abutment element in base element 50. Therefore, in the switch disclosed in the Meuer patent, the contactor rod 58 contacts terminals 52 only along the forwardly positioned edges 90 thereof.

In the switch embodying the teachings of the present invention, the above-discussed distance of travel of plunger 62 exceeds the lengthwise dimension 94 of the elliptical openings 54. Therefore, for the horizontal orientation shown in FIG. 3, the contactor rod 58 will contact the edges 90 of the openings 54 when the plunger 62 is in its forwardmost position, and will also contact the terminals along the edges 92 of openings 54 when the plunger is moved rearwardly toward the above-discussed rearmost position. The contactor rod will remain out of contact with the terminals when the plunger is positioned between the forwardmost and the rearmost positions. Therefore, the rearmost position of plunger 62 in the switch embodying the present invention corresponds to that position whereat contactor rod 58 contacts the terminals along the edges 92 thereof, rather than whereat rearmost edge 96 of plunger 62 contacts the abutment in base element 50 as described in the Meuer patent.

Therefore, the switch 30 is adapted to assume three positions, rather than two, and the operation thereof is best shown in FIGS. 4A through 4C for a vertically oriented switch. As shown in FIG. 4A, the plunger 62 is in the uppermost, or first, position with contactor rod 58 contacting terminals 52 along edges 90 of openings 54 which are now the upper edges thereof due to the vertical orientation shown in FIGS. 4A–4C. As the plunger 62 is depressed inwardly of base element 50, the switch assumes a second position, such as that position shown in FIG. 4B, wherein the contactor rod 58 does not contact the terminals 52. As the plunger 62 is depressed still further inwardly of the base element 50, the switch assumes a third position wherein contactor rod 58 contacts the terminals 52 along the edges 92 of the openings 54 which are the lower edges, as shown in FIG. 4C. Thus, in the third position, the circuit in which the switch 30 is connected to completed. The switch 30 therefore completes the circuit when that switch is in the first and third position and is an open element when it is in the second position.

Therefore, with reference to FIG. 2, the switch 30 is normally open when face plate 24 depresses plunger 62 into the second position shown in FIGS. 2 and 4B. However, if the face plate 24 is removed, the plunger 62 will move outwardly of base element 50 into the first position shown in FIG. 4A wherein the circuit is completed and activates the alarm circuit 34.

Additionally, if a potential intruder attempts to circumvent the anti-tamper switch 30 using the above-described method wherein a hole is drilled through medial rib 28 in the face plate 24 and a stiff rod is inserted through that hole of depress plunger 62 while the face plate 24 is being removed to gain excess to the kep operated control switch 20, the chances are extremely high that the rod will push plunger 62 inwardly of the base element 50 into the third position shown in FIG. 4C. As above discussed, when the switch 30 is in the third position, the alarm circuit 32 is activated in a manner which is identical with the manner which the circuit is activated when the switch is in the first position. As above discussed, for a horizontal orientation such as shown in FIG. 3, the distance between the rearmost orientation of the plunger 62 when the switch is in the second position and the orientation of the plunger when the switch is in the third position can be selected to produce any desired degree of sensitivity for switch 30 by varying lengthwise dimension 94. Thus, the distance between the lowermost orientation of the plunger in the second position and the plunger orientation of the third position can be selected so that the switch assumes the third position when a hole through medial rib 28 is made, yet the switch will not assume the third position if the face plate is inadvertently bumped.

As discussed in the Meuer patent, the switch 30 can be either the normally open type of the normally closed type. The terminals of the FIGS. 4 and 5 embodiment shown in the Meuer patent are modified to produce a normally closed switch in accordance with the teachings of the present invention. Therefore, as best shown in FIGS. 5A through 5C of the present disclosure, and for the vertical orientation there shown, the upper portion of each terminal 52 is punched out or cut away to provide a pair of reentrant (or downwardly extending) resilient arms 100 and 102; the adjacent edges of these arms being spaced apart a distance slightly less than the diameter of the contactor rod 58, whereby that contactor rod is adapted upon a predetermined degree of downward movement of the plunger, to engage the pairs of arms 100 and 102 to bridge the terminals and close the circuits in which the switch is connected. The end of each terminal which is the upper end in the vertical orientation shown in FIGS. 5A through 5C, is also cut away, as indicated by the downwardly and inwardly angled edges 104 and 106 of the arms respectively to facilitate engagement of the contactor 58 with the respective members and to insure a proper degree of spacing of the arms from the contactor rod in the circuit-interrupting position of the switch. The switch is shown in FIGS. 5A through 5C to be vertically oriented, however, the switch can assume any suitable orientation. Thus, the vertical orientation, and references thereto for all embodiments of the present invention, are made for the sake of convenience and are not intended as limitations.

Thus, for the vertical switch shown in FIGS. 5A through 5C, the arms 100 and 102 are positioned in a terminal opening which is defined by the terminals and the arms 100 and 102 and hence is indicated in a general manner by the numeral 54'. The arms have edges 107, which are the upper edges thereof, and edges 108, which are the lower edges thereof, and a lengthwise dimension 109. In accordance with the teachings of the present invention, the lengthwise dimension 109 of the terminal opening 54' is less than the distance of movement of the plunger mounted contactor rod 58 so that the switch is adapted to assume a first position wherein the contactor rod is located in an open area 110 defined at the top of the opening 54' (FIG. 5B) wherein the circuit is open, a second position (FIG. 5A) wherein the contactor rod 58 is in contact with arms 100 and 102 to close the circuit, and a third position (FIG. 5C) wherein the contactor rod 58 is located in open area 112 defined between the lowermost extremity of arms 100 and 102 and lower edge 92' of terminal opening 54'. Therefore, the switch shown in FIGS. 5A to 5C is also a three position switch similar to the switch shown in FIGS. 1 through 4. However, the switch in FIGS. 5A through 5C operates in a manner which is opposite to that of the aforementioned switch. Thus, the first and third positions of the FIGS. 5A through 5C embodiment open the circuit, and the second position of that switch closes the circuit. However, the purpose of the switch is similar to the aforementioned switch.

As discussed with respect to the FIG. 3 embodiment, and for the orientation shown in FIGS. 5A through 5C, the distance between the lowermost orientation of the plunger when the switch is in the second position and the orientation of the plunger when the switch is in the third position can be selected to produce any desired degree of sensitivity for the switch by varying the lengthwise dimension 54'. Thus, the distance between the lowermost orientation of the plunger in the second position and the plunger orientation of the third position can be selected so that the switch assumes the third position when a hole through medial rib 28 is made, yet the switch will not assume the third position if the face plate is inadvertently bumped.

It is here noted that the terminal openings 54 and 54' need not be elliptical and can assume other shapes, such as the shape shown in FIG. 9 of the Meuer patent.

To further insure against tampering using the above-discussed method, the plunger 62 can be made of a very hard material and have thereon a bulletlike tip 114, such as the one shown in FIG. 6. The hard material will prevent a drill bit from biting into the material of the plunger thereby forming a pocket at the tip so that the rod is prevented from slipping. The hard material prevents formation of such a pocket. The tip 114 is located on that portion of the plunger which is located outwardly of the switch body and comprises an apex 116 located on the outermost portion of that tip and adapted to contact undersurface 118 of the medial rib 28 to depress the plunger into the normal (second) position. The bulletlike shape of the tip 114 is intended to cause a sharp instrument inserted through a hole made in medial rib 28 to slide off of the apex 116 and lose contact with the plunger. In this manner, the further depression of plunger 72 is made more difficult thereby increasing the chances of accidentally forcing the plunger into the third position to activate the alarm system. The sides of the tip 114 can also have means, such as channels, to further guide an instrument, such as a hanger, off apex 116.

As this invention may be embodied in several forms without departing from the spirit or essential characteristics thereof, the present embodiment is therefore illustrative and not restrictive, since the scope of the invention is defined by the appended claims rather than by the description preceding them, and all changes that fall within the metes and bounds of the claims or that form their functional as well as conjointly cooperative equivalents, are therefore intended to be embraced by those claims.

What is claimed is:

1. An electric switch for controlling an electric circuit of the type including a pair of terminals mounted in an insulating body and each having defined therein an opening and an electrically conductive contactor rod mounted on an electrically insulative non-rotatable plunger for movement therewith, the rod extending between the terminals to contact same, the plunger being movably received within the body to move inwardly and outwardly thereof and the contactor rod being received in the terminal openings for selectively connecting the terminals together when the plunger is in a first position to complete an electric circuit when the contactor rod contacts both terminals, and breaking the electric circuit when the plunger is in a second position when the connector rod is positioned to be out of contact with the terminals, means for mounting the base on a mounting element including a face plate, an insulating member mounted in the base and engaging the terminals for holding the plunger and preventing short-circuiting, and means for biasing the plunger outwardly of the body, the plunger abutting said face plate to hold that plunger in the first position, the improvement comprising: sizing the lengthwise dimension of the opening in each of the terminals to be less than the distance which the plunger can move inwardly of the body so that the contactor rod will assume a third position contacting both terminals at a location spaced from said first and second positions wherein the electric circuit is activated when the plunger is pushed into the body a predetermined distance beyond the second position.

2. The electric switch of claim 1 wherein the switch is of the normally open type with the first and third positions closing the electric circuit and the second position opening the circuit.

3. The electric switch of claim 1 wherein the switch is of the normally closed type with the first and third positions opening the electric circuit and the second position closing the circuit.

4. The electric switch of claim 1 wherein the improvement further includes a top on the plunger which is bullet-shaped with the apex thereof being remotely located from the plunger.

5. The electric switch of claim 1 wherein the improvement further comprises a coupling element having a bore therethrough for receiving the plunger and means for attaching said coupling element to the body so that the switch can be mounted on a mounting means.

6. The electric switch of claim 5 wherein the improvement further comprises a sleeve having a bore and surrounding said coupling element for maintaining a predetermined spacing between said mounting means and said body.

7. An electric switch for controlling an electric circuit of the type including a pair of terminals mounted in an insulating body and each having defined therein an opening and an electrically conductive contactor rod mounted on an electrically insulative non-rotatable plunger for movement therewith, the terminals each having an elongate electrical contact means integral therewith and located within the terminal opening, the rod extending between the terminals to contact same, the plunger being movably received within the body to move inwardly and outwardly thereof and the contactor rod being received in the terminal openings for selectively connecting the terminals together when the plunger is in a first position within the terminal openings to complete an electric circuit when the contactor rod contacts the terminal electrical contact means of both terminals, and breaking the electric circuit when the plunger is in a second position when the connector rod is positioned in the openings to be out of contact with the terminal electrical contact means, means for mounting the base on a mounting element including a face plate, an insulating member mounted in the base and engaging the terminals for holding the plunger and preventing short-circuiting, and means for biasing the plunger outwardly of the body, the plunger abutting said face plate to hold that plunger in the second position, the improvement comprising: sizing the lengthwise dimension of the terminal electrical contact means in each of the terminals to be less than the distance which the plunger can move inwardly of the body so that the contactor rod will assume a third position in the terminal openings out of contact with the terminal electrical contact means at a location spaced from the first and second positions wherein the electric circuit is broken when the plunger is pushed into the body a predetermined distance beyond the second position.

* * * * *